United States Patent [19]

Toso

[11] Patent Number: 4,813,080

[45] Date of Patent: Mar. 21, 1989

[54] UPPER TORSO GARMENT WITH INTEGRAL BACK SUPPORT

[76] Inventor: Victor Toso, 842 - 22nd Ave., SE., Minneapolis, Minn. 55414

[21] Appl. No.: 104,995

[22] Filed: Oct. 6, 1987

[51] Int. Cl.[4] ..... A47C 20/00; A61D 1/00

[52] U.S. Cl. ..... 2/94; 2/44; 128/78; 297/464; 5/432

[58] Field of Search ..... 2/94, 44; 5/432, 431, 5/443, 445; 128/60, 78, 134, 133; 297/464, 465; 272/126, 135, 137

[56] References Cited

U.S. PATENT DOCUMENTS

| | | | |
|---|---|---|---|
| 879,534 | 2/1908 | Fraser | 5/443 |
| 2,418,009 | 3/1947 | Berman | 2/44 |
| 2,939,462 | 6/1960 | McClung | 2/44 |
| 2,948,898 | 8/1960 | Allen | 2/94 |

FOREIGN PATENT DOCUMENTS

| | | | |
|---|---|---|---|
| 28347 | 7/1931 | Australia | 5/432 |
| 960101 | 4/1950 | France | 5/432 |
| 5919 | of 1915 | United Kingdom | 5/432 |

*Primary Examiner*—Alexander Grosz
*Attorney, Agent, or Firm*—N. J. Aquilino

[57] ABSTRACT

An upper torso garment including an integrally formed back support member adapted to engage the lumbar region of a wearer. A pair of straps extend longitudinally from the ends of the support member and terminate in loops to engage the knees of the wearer when the wearer is seated on the ground or on a backless support such as a bench, or the like. The force of the wearer's knees on the straps pulls the back supporting member against the back of the wearer supporting the back and enabling the wearer to sit upright comfortably for extended periods of time.

10 Claims, 2 Drawing Sheets

UPPER TORSO GARMENT WITH INTEGRAL BACK SUPPORT

BACKGROUND OF THE INVENTION

The present invention relates to a back support device, and in particular, to a device for supporting the lower back region of a person combined with an upper torso garment.

In many outdoor activities, an individual must be seated upright on a flat surface without a rigid back support, such as on the ground or a floor, or in a backless chair, bench or the like. For example, spectators at athletic games often sit for extended periods of time on backless benches. Similarly, hunters an/or other outdoorsmen may be required to sit on various types of backless supports when hunting, eating, sitting by a fire, and the like. Many persons find such positions uncomfortable because of the lack of support at the lumbar region and such discomfort will often occur after a relatively short period of time for persons with poor posture and/or weak back structures.

In my co-pending patent application entitled "Back Support", Ser. No. 06/917,497, filed Oct. 10, 1986 now U.S. Pat. No. 4,773,106 I disclosed a back support formed of a flexible padded member which engages the lumbar portion of a wearer and having straps attached to the end of the support member which are adapted to loop around the knees of the wearer when in a seated position to maintain tension against the wearer's back.

THE INVENTION

The present invention is directed to an upper torso garment which includes an integrally formed back support member adapted to engage the lumbar region of a wearer and which further includes a pair of straps extending longitudinally from the ends of the support member and which terminate in loops to engage the knees of the wearer when the wearer is seated on the ground or on a backless support such as a bench, or the like.

Each strap is secured by a suitable buckle which is adjustable so that the length of the straps may be fitted to various sized individuals. The straps may include knee pads which cover the knees of the user when the support is in place to provide comfort to the knees when the support is worn.

The general object of the invention is to provide a back supporting device which is integrally formed with an upper torso engaging garment which enables one to sit upright comfortably for long periods of time without a rigid back support.

It is a particular object of the present invention to provide a garment having an integral lower back support device to be worn during outdoor activities in situations where the individual would be sitting on a ground surface cross legged, or in a position with the legs uncrossed and knees up, and in a position on a backless chair, bench, or similar support.

It is a further object of the present invention to provide a garment including a flexible back support which is adjustable to fit various sized individuals and which is adjustable for a variety of sitting positions.

DESCRIPTION OF THE PREFERRED EMBODIMENT

Figure 1:
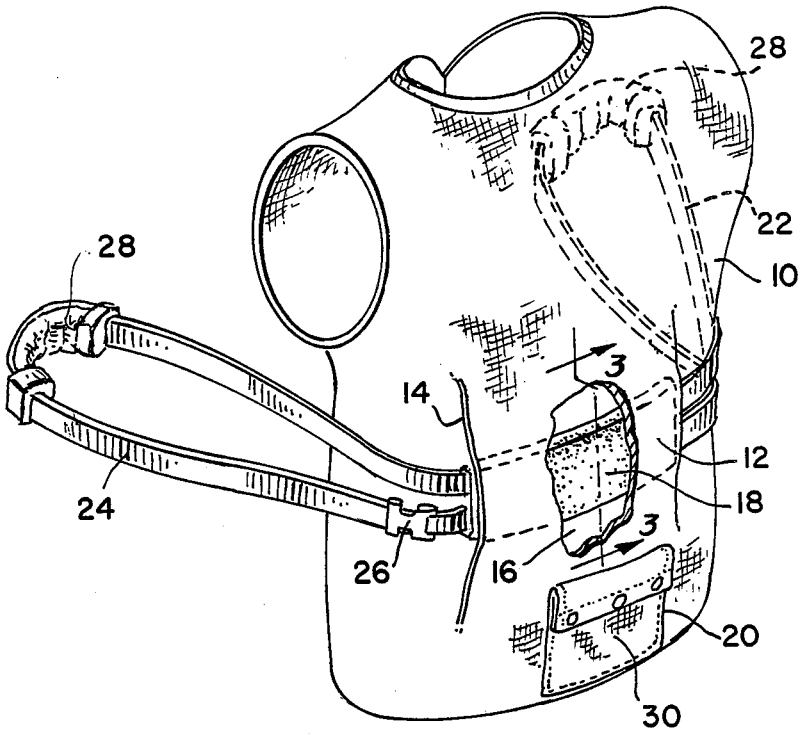
FIG. 1 is a perspective view of a garment including the back support in accordance with the present invention.
Figure 2:
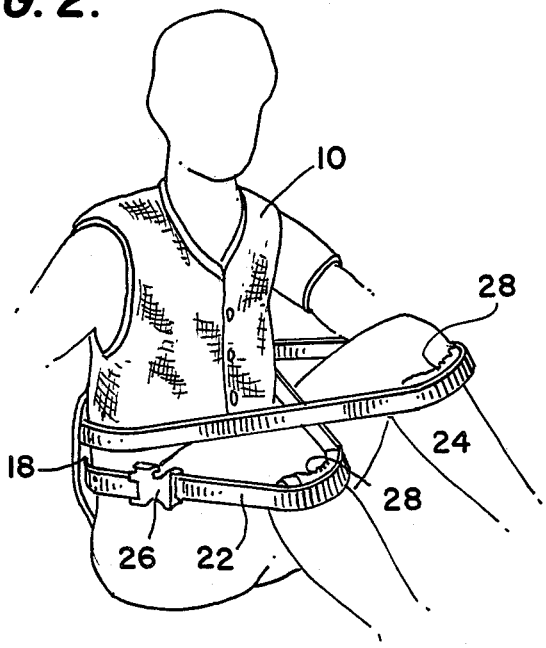
FIG. 2 is a frontal perspective view of an individual seated on a ground surface wearing the garment of the present invention.
Figure 3:
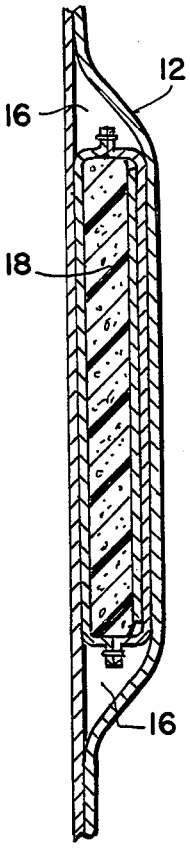
FIG. 3 is a partial sectional view taken along the lines 3—3 of FIG. 1.

FIGS. 1, 2 and 3 illustrate an upper torso garment and integrally formed back support member of the present invention. The garment 10 is illustrated as a sleeveless vest, but it will be appreciated that any type of upper torso engaging garment can be used in keeping within the scope of the present invention. As illustrated, the garment 10 includes an integrally formed backpocket 12 having a suitable opening 14 and interim pocket structure 16. In a preferred embodiment, a support pad 18, which may include a thickened cushion for comfort, is permanently sewn into the pocket 12 formed on the lower back panel 20 of the jacket. A pair of elongated straps 22 and 24 are integrally attached to the support pad 18 and extend from the sides of the back panel 20 to form a pair of loops as shown. Each of the straps 22 and 24 includes a buckle 26 which may be adjustable and which permits the straps to be lengthened or shortened where appropriate. Each of the straps 22 and 24 may also include knee pads 28 which are adjustably positioned along the length of each of the straps 22 and 24 using a suitable support means. Preferably, the jacket would include a rear pocket 30 where the straps may be supported when not in use. The straps 22 and 24 are made of flexible inelastic cloth or slightly elastic cloth material of sufficient strength to withstand the body forces against them when they are used.

Referring to FIG. 2, a user is shown wearing a jacket 10 of the present invention which includes an integrally formed support pad 18 and straps 22 and 24. In use, the straps are adjusted to fit the particular wearer and then are looped over the knees of the wearer when in a seated position as shown. The straps then pull the support pad 18 against the lumbar region of the wearer's back to provide suitable support. The knee pads 28 are positioned on the wearer's knees. When not in use, the straps may simply be folded and placed in the compartment 30 thereby permitting the jacket to be worn in a normal manner.

Figure 4:
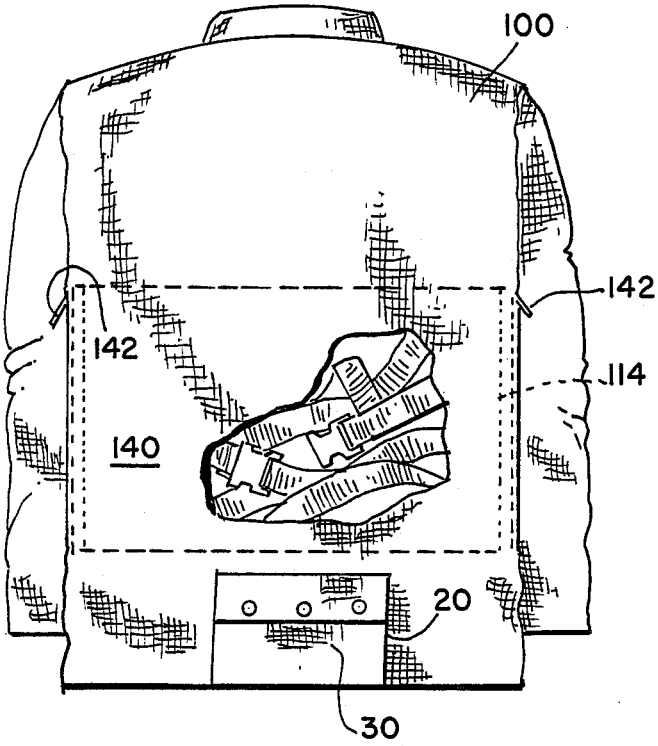
FIG. 4 is a view of a second embodiment of the present invention with a portion partially broken away to show an interior of the garment.
Figure 6:
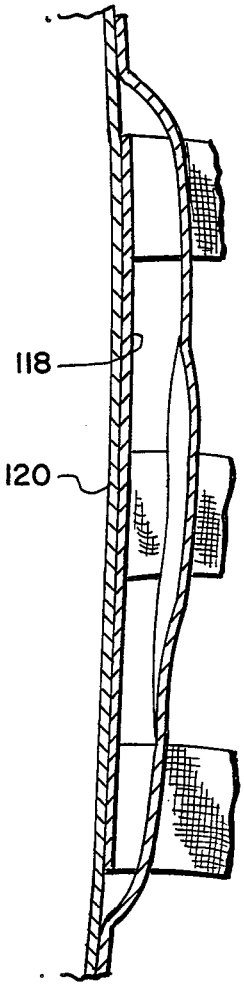
FIG. 6 is a sectional view taken along the lines 6—6 of FIG. 5.
Figure 5:
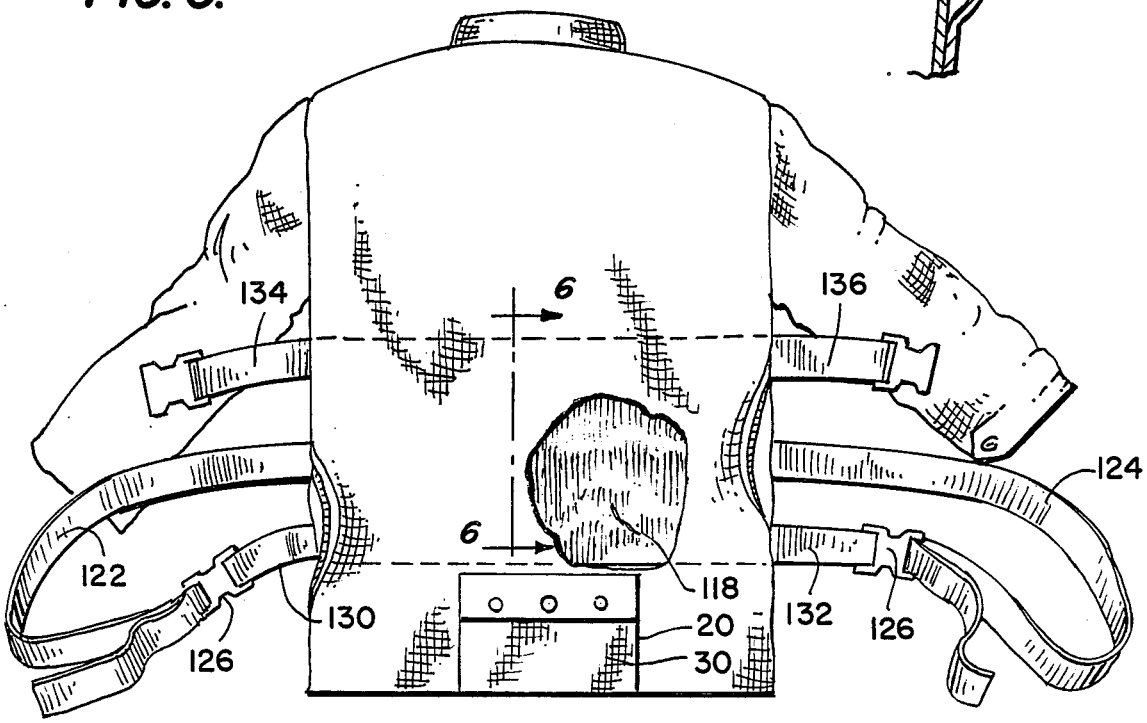
FIG. 5 is a view of the embodiment of FIG. 4 with the straps extended.

FIGS. 4, 5 and 6 illustrate a second embodiment of the present invention including an upper torso garment 100 having sleeves. Integrally formed support pad 118 is permanently attached into the garment in a pocket 114 of the garment 100. The support pad 118 is formed of heavy cloth or canvas sewn directly onto the back panel 120 of the garment 100 and extends from a point adjacent the lower lumbar region of a wearer to a second point adjacent the mid-dorsal region of the wearer. In this embodiment, a pair of elongated straps 122 and 124 are suitably attached to a back panel on the garment 100. The straps 122 and 124 also include buckles 126 which may be adjustable and which permit the straps to be lengthened or shortened where appropriate.

The garment 100 includes a first pair of anchor straps 130 and 132 which are located immediately adjacent straps 122 and 124 and a second paid of anchor straps 134 and 136 which are located adjacent the upper portion of the support pad 118 at approximately the mid-dorsal region of the back of the wearer of the garment 100.

With this arrangement, a user can secure the straps 122 and 124 to the lower anchor straps 130 and 132 thereby forming loops which engage the knees of the wearer in the same manner as described hereinabove. This will pull the support pad 118 against the lumbar region of the wearer's back to provide a suitable support.

The user also has the alternative of securing the straps 122 and 124 to the upper anchor straps 134 and 136 which pulls the upper portion of the support pad 118 against the dorsal portion of the wearer's back providing support in this area. Using the upper portion of the support pad 118 and the upper anchor straps 134 and 136 can be particularly useful depending upon the position that the wearer assumes relative to a support surface. For example, with a wearer seated on a flat ground surface and with his knees up in the air, the upper support position is more effective in providing increased support and comfort to the user.

The garment 100 includes an exterior pocket 140 having a pair of closure members 142 which are adapted to receive and store the various straps and anchor straps when they are not in use.

It will be appreciated that the above embodiments are not limiting and that various changes may be made in the invention in keeping within the scope of the appended claims.

I claim:

1. An upper torso garment having an integral support device for supporting the back region of a user in a seated position, said garment including a front panel and rear panel and openings to accommodate the arms of the user wherein the improvement comprises:

a double-ended, flexible, rectangular back supporting member having a length substantially spanning the width of the back of said user;

said back supporting member being integrally formed with said back panel of said garment;

elongated straps attached to and extending from the ends of said back panel adjacent said back supporting member;

said straps forming loops and being of such a length to engage the knees of said user when said user is in a seated position;

whereby the force of said user's knees on said straps pulls said back supporting member against the back of said user supporting the same and enabling said user to sit upright comfortably for extended periods of time.

2. The garment of claim 1 wherein said back supporting member is further characterized by a cushion pad.

3. The garment of claim 2 wherein said back panel further includes a pocket and said cushion pad is formed within said pocket.

4. The garment of claim 1 further including knee pads slideably positioned on said straps; said knee pads being sized to cover the knees of said user when said straps engage the knees of said user.

5. The garment of claim 1 further including adjustable buckle means attached to said straps whereby, in use, the length of said straps may be adjusted to fit a particular user.

6. The garment of claim 1 wherein each of said straps includes a spanning section and an anchor strap and said spanning sections and said anchor straps are located adjacent said back supporting member.

7. The garment of claim 1 wherein said back supporting member extends from a first upper point adjacent the mid-dorsal region of a wearer to a second lower point adjacent the lower lumbar region of a wearer.

8. The garment of claim 7 further including a second anchor strap means located above said first anchor straps on said back panel adjacent the mid-dorsal region of said user.

9. The garment of claim 8 further characterized by said second anchor strap means being located adjacent said first upper point on said back supporting member.

10. The upper torso garment of claim 1 further including an exterior pocket formed on said back panel to accommodate and maintain said straps in a non-use position.

* * * * *